US009811979B2

(12) United States Patent
Ma et al.

(10) Patent No.: US 9,811,979 B2
(45) Date of Patent: Nov. 7, 2017

(54) METHOD AND SYSTEM FOR PROCESSING ELECTRONIC CHESS AND CARD DATA

(71) Applicant: Tencent Technology (Shenzhen) Company Limited, Shenzhen (CN)

(72) Inventors: Liang Ma, Shenzhen (CN); Zhiqiang He, Shenzhen (CN); Chunhua Luo, Shenzhen (CN); Jize Yang, Shenzhen (CN)

(73) Assignee: TENCENT TECHNOLOGY (SHENZHEN) COMPANY LIMITED, Shenzhen, Guangdong Province (CN)

( * ) Notice: Subject to any disclaimer, the term of this patent is extended or adjusted under 35 U.S.C. 154(b) by 358 days.

(21) Appl. No.: 14/265,263

(22) Filed: Apr. 29, 2014

(65) Prior Publication Data

US 2014/0235307 A1 Aug. 21, 2014

Related U.S. Application Data

(63) Continuation of application No. PCT/CN2013/088878, filed on Dec. 9, 2013.

(30) Foreign Application Priority Data

Dec. 20, 2012 (CN) ..... 2012 1 0558387

(51) Int. Cl.
*G07F 17/32* (2006.01)

(52) U.S. Cl.
CPC ..... *G07F 17/3293* (2013.01); *G07F 17/326* (2013.01)

(58) Field of Classification Search
CPC ..... G07F 17/32; G07F 17/326; A63F 9/24
See application file for complete search history.

(56) References Cited

U.S. PATENT DOCUMENTS 5,393,067 A * 2/1995 Paulsen ..... G07F 17/32 194/239
6,224,055 B1 * 5/2001 Walker ..... A63F 3/0665 273/139

(Continued)

FOREIGN PATENT DOCUMENTS

CN 101198992 A 6/2008
EP 1378873 A2 1/2004

OTHER PUBLICATIONS

Tencent Technology, ISRWO, PCT/CN2013/088878, Mar. 13, 2014, 8 pgs.

(Continued)

*Primary Examiner* — Tramar Harper
*Assistant Examiner* — Malina D Blaise
(74) *Attorney, Agent, or Firm* — Morgan, Lewis & Bockius LLP

(57) ABSTRACT

In one aspect, a method for dealing cards includes: selecting a respective card distribution configuration from a plurality card distribution configurations stored in a card distribution configuration table, each card distribution configuration being defined by a respective set of meld types and a respective number of occurrences for each of the set of meld types, the respective number of occurrences specifying a total number of times that card combinations matching the meld type occur in a game round; according to the respective number of occurrences for each meld type in the selected card distribution configuration, randomly selecting from a deck of cards a corresponding number of card combinations matching the meld type; distributing the selected card combinations for all of the meld types in the respective card distribution configuration to a plurality of game roles; and distributing a remainder of cards in the deck to the plurality of game roles.

17 Claims, 7 Drawing Sheets

(56) References Cited

U.S. PATENT DOCUMENTS 6,612,927 B1 * 9/2003 Slomiany ..... G07F 17/3244 463/13
7,658,672 B1 * 2/2010 Wolf ..... G07F 17/3223 463/10
7,695,361 B2 * 4/2010 Lind ..... G07F 17/3232 463/19
7,775,868 B2 8/2010 Toyoda
2001/0007828 A1 * 7/2001 Walker ..... G07F 17/3244 463/26
2003/0155716 A1 * 8/2003 Parker ..... A63F 1/00 273/292
2004/0072608 A1 4/2004 Toyoda
2004/0204228 A1 * 10/2004 Walker ..... G07F 17/3244 463/20
2006/0052157 A1 3/2006 Walker et al.
2006/0189371 A1 * 8/2006 Walker ..... G07F 17/3227 463/16
2007/0018406 A1 * 1/2007 Kennedy ..... A63F 1/04 273/307
2007/0126181 A1 * 6/2007 Ciaffone ..... A63F 1/00 273/292
2008/0119254 A1 * 5/2008 Toyoda ..... 463/13
2008/0132306 A1 * 6/2008 Toyoda ..... G07F 17/32 463/11
2008/0139270 A1 6/2008 Toyoda
2008/0161084 A1 * 7/2008 Toyoda ..... G07F 17/32 463/11
2008/0171587 A1 * 7/2008 Jackson ..... G07F 17/32 463/20
2008/0207293 A1 * 8/2008 Toyoda ..... G07F 17/3267 463/13
2008/0220846 A1 * 9/2008 Okada ..... G07F 17/3244 463/20
2008/0220881 A1 * 9/2008 Okada ..... G07F 17/3267 463/43
2009/0023486 A1 * 1/2009 Nakamura ..... G07F 17/32 463/11
2009/0124316 A1 * 5/2009 Baerlocher ..... G07F 17/3227 463/13
2009/0181742 A1 * 7/2009 Jackson ..... G07F 17/32 463/13
2010/0113132 A1 * 5/2010 Sasaki ..... G07F 17/32 463/20
2012/0270631 A1 * 10/2012 Graves ..... G07F 17/32 463/19
2013/0023318 A1 * 1/2013 Abrahamson ..... G07F 17/3293 463/13
2014/0221070 A1 * 8/2014 Lund ..... G07F 17/3293 463/13

OTHER PUBLICATIONS

Tencent Technology, IPRP, PCT/CN2013/088878, Mar. 13, 2014, 5 pgs.

* cited by examiner

METHOD AND SYSTEM FOR PROCESSING ELECTRONIC CHESS AND CARD DATA

RELATED APPLICATIONS

This application is a continuation application of PCT Patent Application No. PCT/CN2013/088878, entitled "METHOD AND SYSTEM FOR PROCESSING ELECTRIC CHESS AND CARD DATA" filed Dec. 9, 2013, which claims priority to Chinese Patent Application Serial No. 201210558387.3, entitled "Method and System for Processing Electronic Chess and Card Data", filed Dec. 20, 2012, the entirety of which is incorporated herein by reference.

FIELD OF THE INVENTION

The present disclosure relates to the technical field of computer data processing, especially relates to an electric chess and card data processing method and system.

BACKGROUND OF THE INVENTION

Regarding to the chess and card games (e.g., Doudizhu, Mahjong, Bridge, Uno, Blackjack, etc.) played at electronic gaming terminals, it is important not only to attract the users with playing methods, but also use a good card dealing algorithm. A good card dealing algorithm can prevent the users from guessing the cards or giving up too soon for getting a good hand for too long.

Before a better card dealing algorithm is used, the more general practice is to adopt the strategy of dealing random cards to the users, i.e. it assigns all the cards to each player according to the randomized strategy. This random card dealing algorithm is quite simple, however, the distribution of cards into meaningful combinations can't be controlled. All players' cards may be randomly dispersed and the probability of getting a good hand is relatively small.

Another card dealing method used presently generates a fixed set of multiple good card configurations, then choose one good card configuration from the fixed set to assign to each player every time. In this way, it can control the appearance of good card combinations. However, it would be not easy to control the probability of having each special card configuration to occur. Also, the ability to control the good card and bad card combinations is poor. In addition, the ability to control the probability of particular card combinations is limited to a single round of the game, rather than a large number of rounds or games. Consequently, as time progresses, it is hard to ensure the same probability of occurrence over a large number of rounds and games. The more serious problem is that it is very difficult to make the current card dealing technology to dynamically configurable. The probability of occurrence for various card combinations must be generated in advance, and the card dealing algorithm can't be reconfigured easily. Therefore, each modification to the card dealing strategy needs to be performed on the backend server, resulting in a low efficiency.

SUMMARY

In order to address the problems in the prior art, the embodiments of the present invention provide a method and device for assigning/dealing game pieces (e.g., cards) in electronic card and chess games.

In one aspect, the method for dealing cards in an electronic card game includes: selecting a respective card distribution configuration from a plurality card distribution configurations stored in a card distribution configuration table, each card distribution configuration being defined by a respective set of meld types and a respective number of occurrences for each of the set of meld types, the respective number of occurrences specifying a total number of times that card combinations matching the meld type occur in a game round; according to the respective number of occurrences for each meld type in the selected card distribution configuration, randomly selecting from a deck of cards a corresponding number of card combinations matching the meld type; distributing the selected card combinations for all of the meld types in the respective card distribution configuration to a plurality of game roles; and distributing a remainder of cards in the deck to the plurality of game roles.

In some embodiments, a device includes one or more processors and memory storing one or more programs for execution by the one or more processors, the one or more programs include instructions for performing the operations of the methods described herein. In some embodiments, a non-transitory computer readable storage medium storing one or more programs, the one or more programs comprising instructions, which, when executed by a device with one or more processors, cause the device to perform the operations of the methods described herein.

Various advantages of the present invention would be apparent in light of the descriptions below.

BRIEF DESCRIPTION OF THE DRAWINGS

The aforementioned features and advantages of the invention as well as additional features and advantages thereof will be more clearly understood hereinafter as a result of a detailed description of preferred embodiments when taken in conjunction with the following drawings.

Like reference numerals refer to corresponding parts throughout the drawings.

DETAILED DESCRIPTIONS

Reference will now be made in detail to embodiments, examples of which are illustrated in the accompanying drawings. In the following detailed description, numerous specific details are set forth in order to provide a thorough understanding of the subject matter presented herein. But it will be apparent to one skilled in the art that the subject matter may be practiced without these specific details. In other instances, well-known methods, procedures, components, and circuits have not been described in detail so as not to unnecessarily obscure aspects of the embodiments.

In order to further explain the technological means and efficacy taken by the present invention for achieving the preset invention purposes, by combining with the attached drawings and better embodiments, the following has explained in detail its concrete implementation modes, methods, steps, structures, characteristics and efficacy of the proposed electric chess and card data processing methods and systems based on the present invention.

The electric chess and card data processing method and system proposed by the present invention is applicable for the chess and card games that can be played on electronic devices (e.g., electronic game consoles, smartphones, tablet computers, etc.) that can be taken as gaming terminals. Example games may include: Poker, Bridge, Doudizhu, Mahjong, Chinese Chess, Chinese Checkers, Army Chess, Othello, Gobang, etc.

Figure 1:
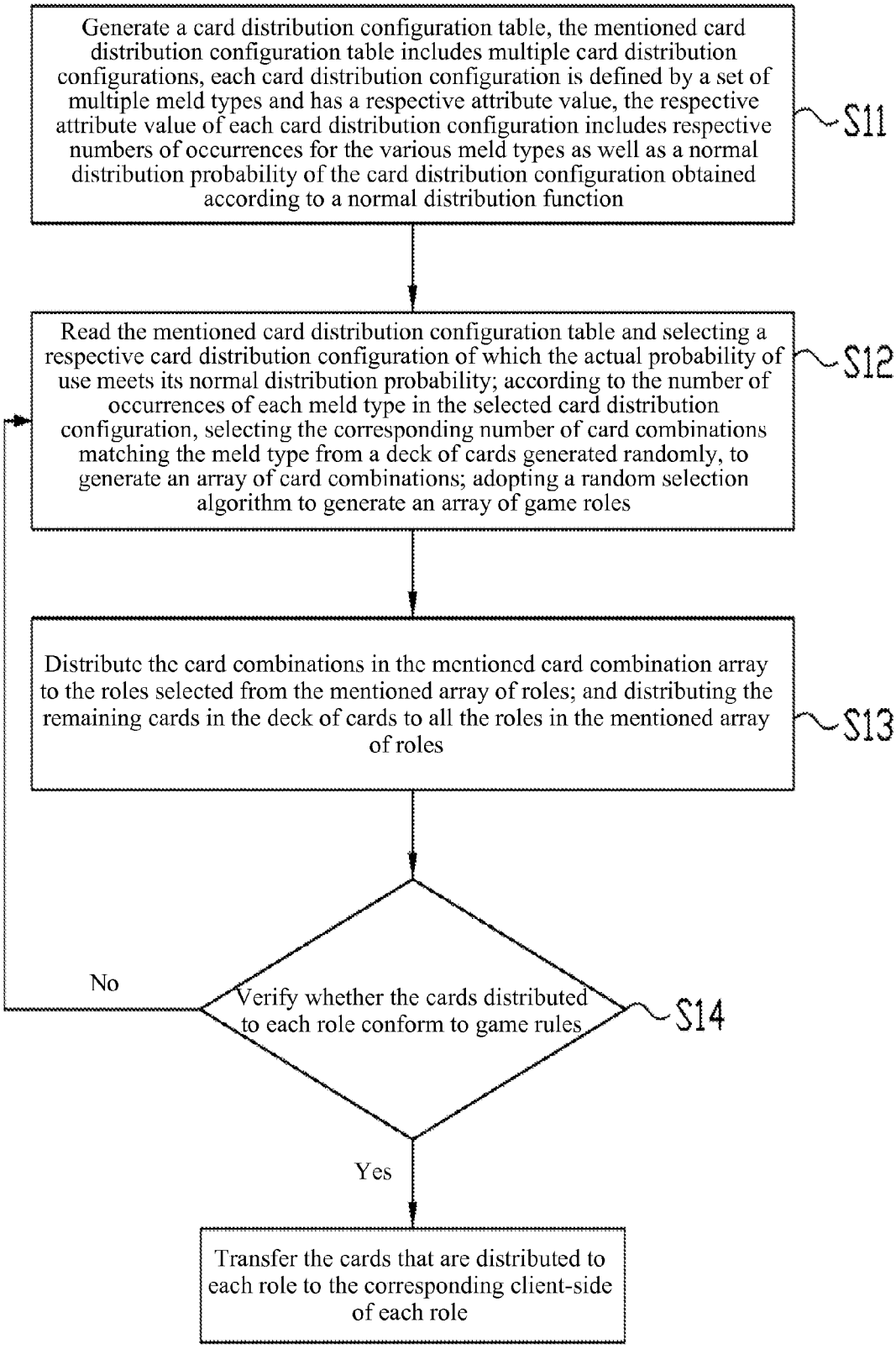
FIG. 1 is a flowchart diagram of electric chess and card data processing method in accordance with some embodiments.

FIG. 1 is a flowchart diagram of an exemplary electric chess and card data processing method in accordance with some embodiments. In some embodiments, the electric chess and card data processing method includes:

S11: Generate a card distribution configuration table, the mentioned card distribution configuration table specifying multiple different card distribution configurations. Each card distribution configuration is defined by a respective set of meld types and a respective attribute value corresponding to each of the meld types. In some embodiments, the respective attribute value of each meld type specifies a respective total number of times (i.e., a respective count) that card combinations matching the meld type occur in a game round, and a respective probability of occurrence for the card distribution configuration. In some embodiments, the respective probabilities of occurrence for the different card distribution configurations are obtained using a normal distribution function. For example, some very good card distribution configurations (e.g., lots of pre-established melds) have relatively low probabilities of occurrence, while some very poor card distribution configurations (e.g., few pre-established melds and lots of random loose cards) have. In general, average card distribution configurations (e.g., some pre-established melds and some random loose cards) account the highest probabilities of occurrences.

In consideration of the flexibility of the card distribution configuration table, the different possible card distribution configurations as well as the number of times each meld type may occur in a particular card distribution configuration are all configurable depending on the product strategies of the game service provider.

Figure 2:
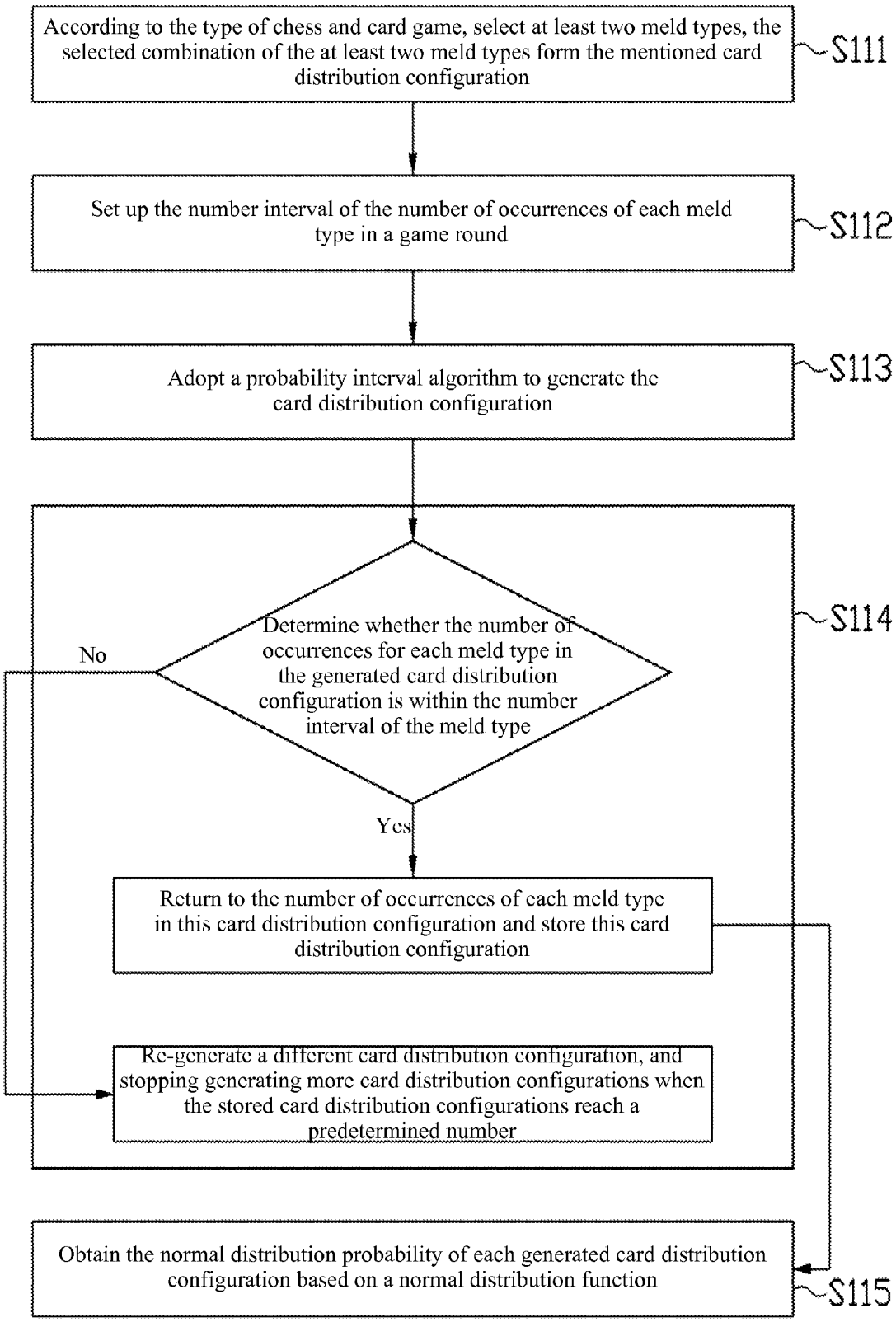
FIG. 2 is a flowchart diagram of Step S11 in FIG. 1, in accordance with some embodiments.

FIG. 2 is a flowchart diagram of Step S11 in FIG. 1, in accordance with some embodiments. In some embodiments, Step S11 can further include the following steps:

S111: According to the type of chess and card game in question, select at least two kinds of meld types permissible in the game, the selected combination of the at least two kinds of meld types provide the basis to form all of the card distribution configurations in the card distribution configuration table. In some embodiments, the at least two kinds of meld types selected for the respective card distribution configuration are meld types that are considered relatively "good" or "strong" meld types in the game.

The selected meld types may vary depending on the specific type of chess and card game. For example, in the "Doudizhu (斗地主)" game of playing cards, the possible meld types or "good" meld types include "Shunzi" or "run" (e.g., a sequence of more than five cards having consecutive ranks, such as 5♦ 4♥ 3♠ 2♦ A♦"Zhadan" or "quadruplet" (e.g., four cards having the same rank, such as 7♣ 7♥ 7♠ 7♦), "Sanzhang" or "triplet" (e.g., three cards having the same rank, such as 3♣ 3♦ 3♠ ), "Liandui" or "consecutive pairs" (e.g., two cards having the same rank with two cards having the adjacent rank, such as 9♥ 9♠ 8♥ 8♠ ). therefore, the combination of different numbers of possible or good meld types (e.g., "Shunzi", "Zhadan", "Sanzhang" and "Liandui") forms a respective possible or good card distribution configuration. According to the different numbers of times that the different meld types (e.g., "Shunzi", "Zhadan", "Sanzhang" and "Liandui" may occur in a game round, different combinations of the meld types can form different card distribution configurations. For example, the combination of one (1) "Shunzi", zero (0) "Zhadan", two (2) "Sanzhang" and zero (0) "Liandui" forms a first card distribution configuration; and zero (0) "Shunzi", three (3) "Zhadan", zero (0) "Sanzhang" and one (1) "Liandui" forms another card distribution configuration. In some embodiments, a list of all possible meld types can be stored in a seed list or database in advance for use in generating the card distribution configuration table. In some embodiments, a list of "good" (e.g., desirable) meld types can be stored in a seed list or database for use in generating the card distribution configuration table. In some embodiments, which meld types are used in the card distribution configuration table is a configurable aspect of the present invention.

S112: Set up the respective number range for the total number of occurrences for each of the above-mentioned meld types in any given game round.

For each of the already selected meld types, set up the number range for the total number of occurrences for the meld type, i.e. set up the maximum number of times this meld type can occur in a game round. In some embodiments, the number range can be configured by a person in advance, and the specific number is customized according to a particular product strategy. For example, In some embodiments, the range for the total number of occurrences for the meld type "Shunzi" is set as [0, 5], i.e. at most five "Shunzi" can be generated the cards dealt out in a game round; and at the minimum, no "Shunzi" is generated in the cards dealt out in a game round. The respective number range can be established for each of the other selected meld types.

S113: Generate the card distribution configurations for the card distribution configuration table based on a probability interval algorithm.

In the Step S113, the probability intervals corresponding to all of the possible number of occurrence for each of the selected meld types are set according to the type of chess and card game in question. In some embodiments, each probability interval is a multiple of one percent (%).

Continue to take the example of the meld type "Shunzi", as shown in Table 1, the number interval of "Shunzi" has been set as [0,5]; therefore, the possible numbers of occurrences of "Shunzi" are respectively 0, 1, 2, 3, 4 and 5. In some embodiments, the probability intervals corresponding to these numbers of occurrences are set in terms of percentages of 100 percent. For example, in Table 1, the probability interval of having zero (0) "Shunzi" is set as 0-5%; the probability interval of having one (1) "Shunzi" is set as 5-15%; the probability interval of having two (2) "Shunzi" is set as 15-35%; the probability interval of having three (3)

"Shunzi" is set as 35-50%; the probability interval of having four (4) "Shunzi" is set as 5-15%, and the probability interval of having five (5) "Shunzi" is set as 0-5%.

TABLE 1

| Number of "Shunzi" | 0 | 1 | 2 | 3 | 4 | 5 |
|---|---|---|---|---|---|---|
| Probability interval (%) | 0-5 | 5-15 | 15-35 | 35-50 | 5-15 | 0-5 |

In some embodiments, the following steps are performed for each selected meld type to generate the card distribution configurations in the card distribution configuration table: (1) randomly generate a large number a (e.g., a number in the range of $10^5$-$10^7$; 2) calculate the remainder of this large number divided by 100 (i.e., a modulo 100); and set the number corresponding to the probability interval of this remainder as the number of occurrences for this meld type.

Continuing with the example of "Shunzi" above, the big number generated is, for example, 1013904223. The remainder of 1013904223 divided by 100, i.e. the remainder by taking the modulus of 100 for 1013904223, is 1013904223%100=23. Since the probability interval corresponding to the remainder value 23 is 15-35%, it can be seen from Table 1 that the number of occurrences corresponding to this probability interval is 2. Thus, the number of occurrences for "Shunzi" in the current card distribution configuration is 2. The same operations are carried out for the other meld types in the current card distribution configuration, and the numbers of occurrences for all of the selected meld types are thus obtained for the current card distribution configuration.

S114: Optionally, verify whether the numbers of occurrences for each meld type in the generated card distribution configuration are within the number ranges established for the meld type. If the result of the verification is affirmative, the numbers of occurrences for each meld type in this card distribution configuration is returned and entered into the card distribution configuration table; otherwise, the card distribution configuration is discarded and another card distribution configuration is generated. The process is repeated until the card distribution configurations in the card distribution configuration table reach a predetermined number (e.g., a total of 40 different configurations).

For example, suppose that, for the card distribution configuration formed by "Shunzi", "Zhadan", "Sanzhang" and "Liandui", the number interval of "Shunzi" is [0,5], the number interval of "Zhadan" is [0,3], the number interval of "Sanzhang" is [0,2], the number interval of "Liandui" is [0,2]. If the generated card distribution configuration has zero "Shunzi", three "Zhadan", three "Sanzhang" and one "Liandui", the number of "Sanzhang" is not in the interval of [0,2], thus this card distribution configuration cannot be kept in the card distribution configuration table, and it needs to re-generated.

S115: Obtain the probability of occurrence for each card distribution configuration in the card distribution configuration table based on a normal distribution function.

Figure 3:
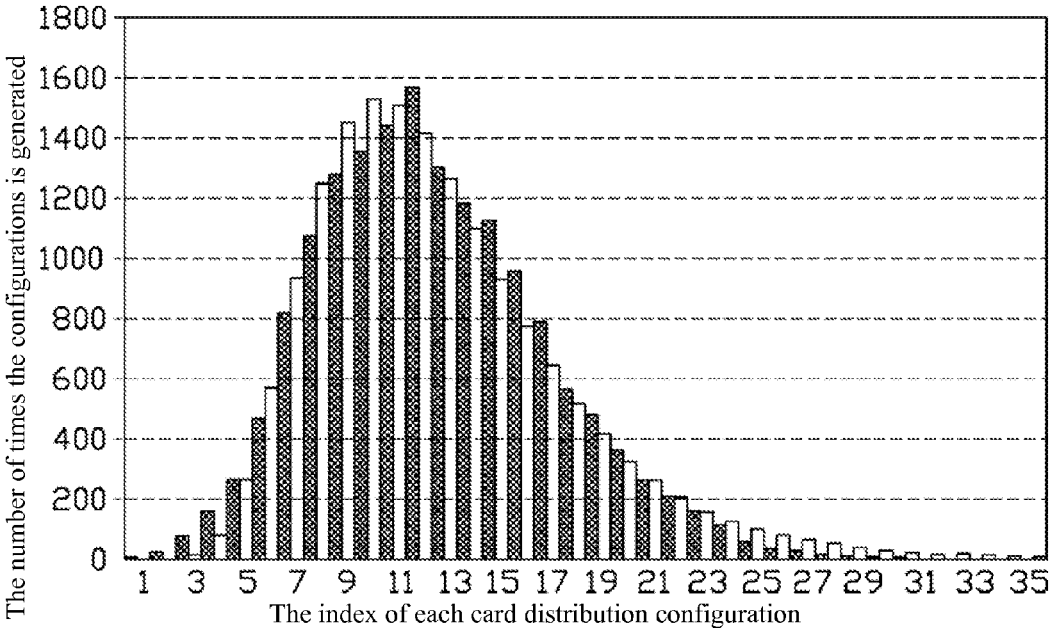
FIG. 3 is a normal distribution diagram of different card distribution configurations in accordance with some embodiments.

FIG. 3 is a normal distribution diagram of different card distribution configurations. In FIG. 3, the X-axis represents the serial number assigned to each card distribution configuration, the Y-axis represents the number of occurrences for each card distribution configuration found in 10000 actual trials. In some embodiments, it is required that the number of occurrence for each card distribution configuration relative to the total number of card distribution configuration generated using the present invention meet the normal distribution. In other words, the probability of occurrence for the poorer card distribution configurations and the better card distribution configurations are always found at the two tail sections of the normal distribution diagram, having relatively small probabilities of occurrences; but most of card distribution configurations are found in the broad center section, represents the high probabilities of getting an average card distribution configuration.

The probability of occurrence for each card distribution configuration is stored with the card distribution configuration in the card distribution configuration table.

The normal distribution probability of each kind of card distribution configuration is a global probability that can be corrected or adjusted (e.g., skewed, shifted, etc.) dynamically across multiple game rounds or games, so as to keep the overall probability of occurrence for each card distribution configuration within a reasonable range. The dynamic correction or adjustment of the normal distribution probability refers to that, every time a new card distribution configuration is selected for a game round, the total number of times that this type of card distribution configuration has already been used in the past is divided by the total number of card distribution configurations that have been selected and used in the past. The result percentage value cannot exceed the probability value of the newly selected card distribution configuration specified by the normal distribution. If the result value exceeds the preset normal distribution probability value for the newly selected card distribution configuration, this selection of card distribution configuration is invalid, and a new selection needs to be made.

Referring back to FIG. 1, S12: Read the above-mentioned card distribution configuration table and select a respective card distribution configuration of which the actual probability of use (i.e., the actual selection frequency) satisfies its normal distribution probability (i.e., the assigned selection probability). According to the number of occurrence for each meld type in the selected card distribution configuration, take the corresponding number of card combinations matching the meld type from a deck of cards generated randomly to generate an array of card combinations for all of the meld types in the selected card distribution configuration. Generate an array of roles for the current players (e.g., assigning different roles, e.g., 1 landlord role, and 2 tenant roles, to the current players according to the rules of the game, e.g., "Doudizhu") using a pseudo-random method.

The generated array of roles refers to the array formed by numbering the different virtual roles using a pseudo-random method. The number of required virtual roles may vary according to different types of chess and card games. For example, when processing the "Mahjong" game data, four roles can be generated; when processing the "Doudizhu" game data, three roles can be generated; when processing the "Chinese Chess" game data, two roles can be generated. In some embodiments, if this data processing method is applied to the common online games, each role may correspond to a client terminal. If this data processing method is applied to a local man-machine game, multiple roles may correspond to one client-terminal. In some embodiments, before taking card combinations from a deck of cards, the deck of cards can be shuffled first using a shuffling program.

Figure 4:
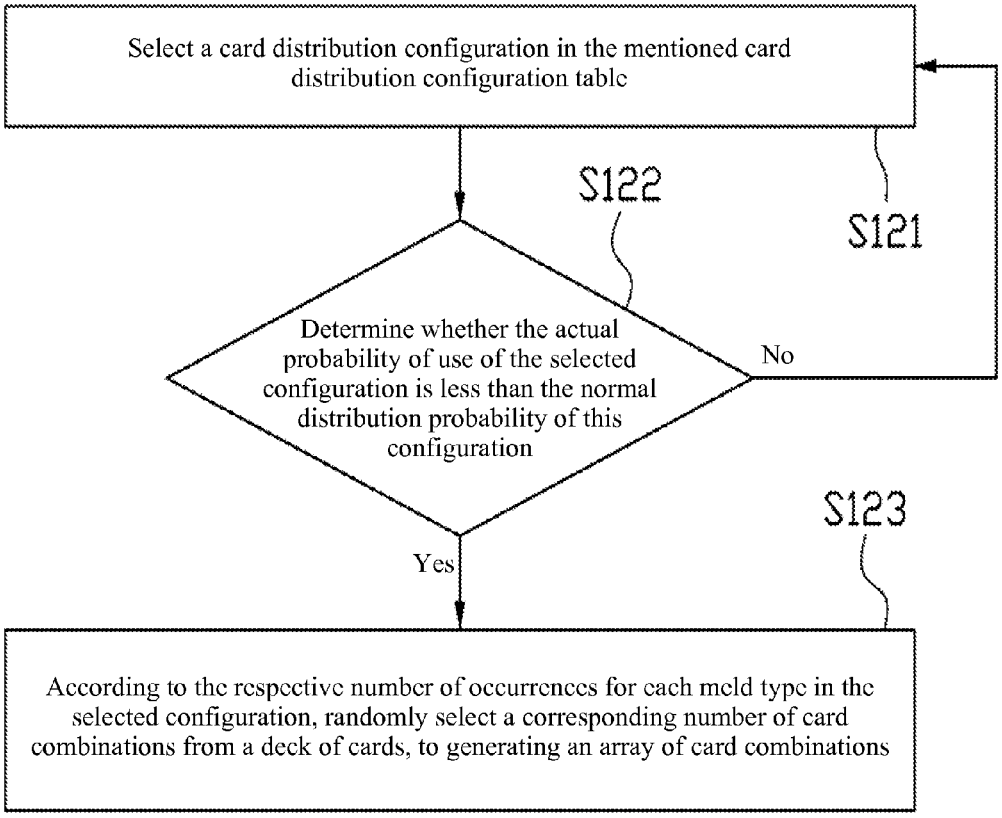
FIG. 4 is a flowchart diagram of Step S12 in FIG. 1, in accordance with some embodiments.

FIG. 4, FIG. 4 is a flowchart diagram of Step S12 in accordance with some embodiments. In some embodiments, Step S12 further includes the following steps:

S121: Select a particular card distribution configuration in the mentioned card distribution configuration table;

S122: Determine whether the actual probability of use (i.e., the selection frequency) for the selected card distribution configuration is less than the normal distribution probability (i.e., the assigned selection probability) of the selected card distribution configuration. If the result of the determination is Yes, then go to S123. Otherwise, go back to Step S121, until that the actual probability of use (i.e., the selection frequency) of the selected card distribution configuration meets its normal distribution probability (i.e., the assigned selection probability).

S123: According to the number of occurrences for each meld type in the selected card distribution configuration, randomly take out a corresponding number of card combinations matching the meld type from a deck of cards, to generate the array of card combinations.

For example, in some embodiments, for the selected card distribution configuration, firstly, it is determined whether the actual probability of use for the selected card distribution configuration is less than the normal distribution probability of the card distribution configuration. In other words, it is determined whether the actual number of use for the card distribution configuration is smaller than the standard number of use for the card distribution configuration (i.e., the normal distribution probability of the card distribution configuration*the sample size). If the result of the determination is Yes, then, according to the number of occurrence for each meld type in the selected card distribution configuration, randomly take out the corresponding number of card combinations matching the meld type from a deck of randomly shuffled cards. For example, supposed that, in the selected card distribution configuration, the number of "Shunzi" is 2, the number of "Zhadan" is 3, the number of "Sanzhang" is 1, and the number of "Liandui" is 2. Then, 8 sets of card combinations, including 2 sets matching the 2 "Shunzi" meld type, 3 sets matching the "Zhadan" meld type, 1 set matching the "Sanzhang" meld type, 2 sets matching the "Liandui" meld type, are taken out of the deck of cards to form the array of card combinations. If the result of the determination is No, another card distribution configuration is read from the card distribution configuration table, and becomes the currently selected card distribution configuration. The above determination of probability is performed again, and the process is repeated until that the actual probability of use of the currently selected card distribution configuration is determined to be less than the normal distribution probability of this card distribution configuration.

For the array of roles, when generating the array of roles, a pseudo-random algorithm is used to ensure there is no discernible pattern in the probability of each meld type be distributed to each role. This can help avoid too big a difference between the meld types assigned to the different roles. In the pseudo-random algorithm, the random number (or random event) is generated randomly in a generation process according to the probability distribution present the experiment samples. Thus, the result of the algorithm is unpredictable.

Optionally, in some embodiments, on account that there are only a small limited number of roles in a game round of Doudizhu or Mahjong-like games (e.g., three roles or four roles), the random effect is not very good, the number of roles can be inflated with a geometric scaling. The algorithm of magnification by geometric scaling is as follows: If the total number of melds % the total number of roles>0, then the average number of melds assigned to a single role=total number of melds (of all types) in the card distribution configuration/the total number of roles. Otherwise, the average number of melds assigned to a single role=[the total number of melds/the total number of roles]+1. Within the range the total number of melds in the card distribution configuration, divide the index number of each card combination in the array of card combinations generated for the card distribution configuration by the average number of melds assigned to a single role, and join into the array of roles. "The average number of melds assigned to a single role=[the total number of melds/the total number of roles]+1" means that, to ensure that the melds (or corresponding card combinations selected from a deck of cards) are distributed evenly to each role, if the total number of melds (or total number of card combinations) can's be divided exactly by the total number of roles, take the rounded number of the division and then add 1 to get the average number of melds assigned to a single role.

Referring back to FIG. 1, S13: the card combinations in the mentioned array of card combinations are randomly distributed to the roles randomly selected from the mentioned array of roles, subject to the constraint of the average number of melds/card combinations to be assigned to each role. Then, the remaining cards in this deck cards are randomly distributed to all the roles in the mentioned array of roles.

Specifically, in some embodiments, a card combination is taken from the array of card combinations at random as the card combination waiting to be assigned to a role. Then, a role is taken at random from the array of roles as the role waiting to be assigned a card combination. If the number of card combinations already assigned to role plus the number of cards of the alternate card type seed is smaller than the average number of melds assigned to a single role, then, the selected card combination is assigned to the selected role. Otherwise, another role is selected at random from the array of roles as the role waiting to be assigned a card combination. Once the selected card combination is assigned to the selected role, the assigned card combination is removed from the array of card combinations. If a role has received a sufficient number of card combinations according to the average number of melds assigned to a single role, that role is removed from the array of roles. Then, the above process is repeated for another card combination in the array of card combinations, until all of the card combinations in the array of card combinations have been assigned. Next, the remaining cards in the deck are randomly distributed to all the roles in the mentioned array of roles, subject to the constraints of the game rules (e.g., the constraints on how many cards each role may hold).

S14: Verify the cards that are distributed to all roles conform to game rules. If the cards are conforming to game rules; the cards that are distributed to each role are transferred to the corresponding client terminals of the role; otherwise, the steps of the mentioned S12-S14 are repeated to distribute another set of cards to the roles.

In some embodiments, when repeating the steps S12-S14 to re-deal the cards, a maximum number of re-dealing N is observed. The re-dealings process is transparent to the client-side. In some embodiments, verifying the cards that are distributed to all roles includes verifying the number of cards assigned to each role, whether the probability of occurrence for the melds assigned to each role exceeds certain preset probabilities, and/or whether the difference of the meld types assigned to the different roles exceeds a preset difference threshold. Step S14 is for verifying that the cards distributed to the roles are compatible with game rules, and whether illegal card distribution configurations have been generated: e.g., incorrect number of cards are given to each role, over generation of certain meld types beyond the normal distribution probability of the meld types, and/or too much disparity between melds given to different roles, etc. If illegal card distribution configuration has occurred, the current round of card dealing has failed, and the card dealing process is restarted from the mentioned step to read the mentioned card distribution configuration table.

Figure 5:
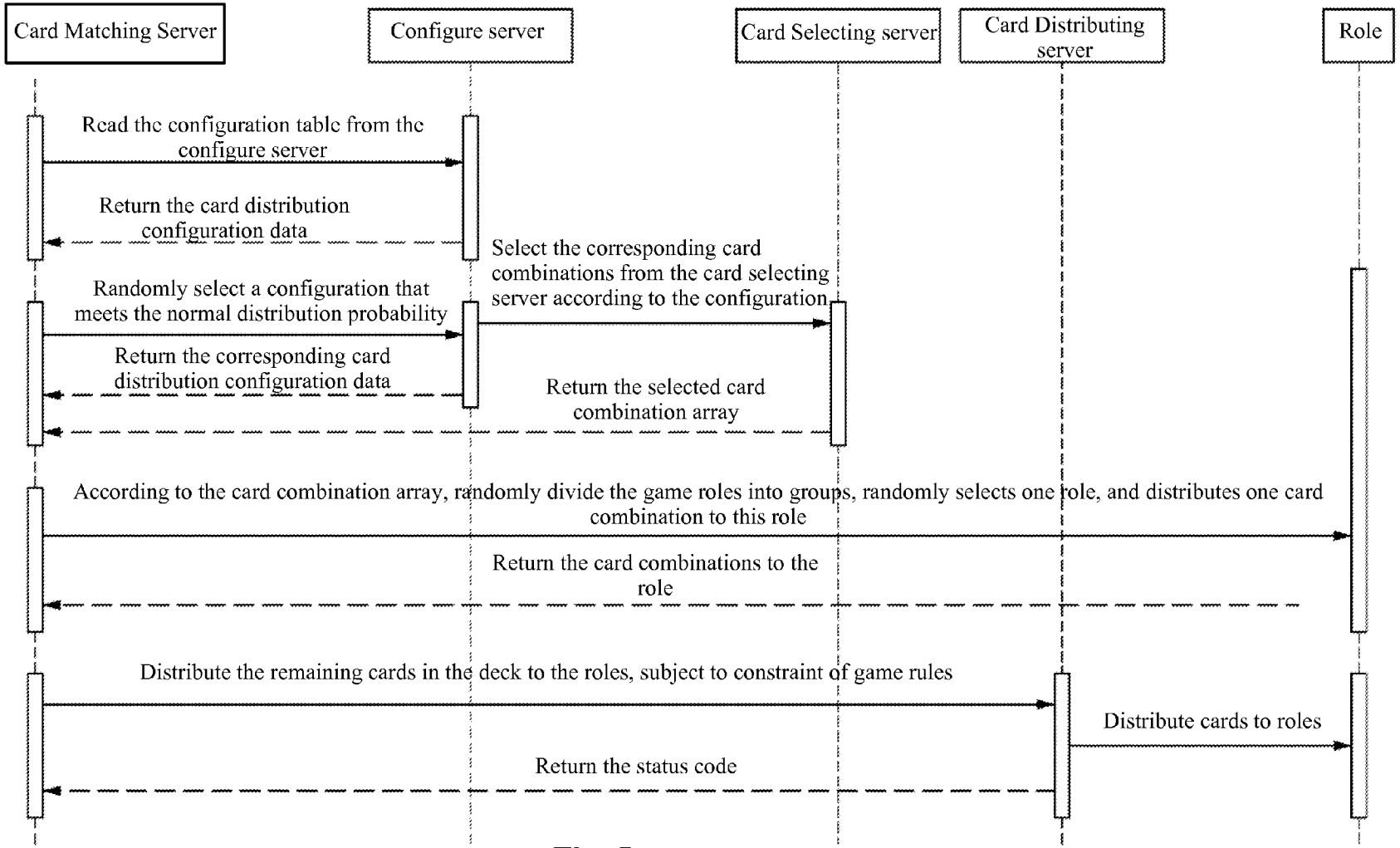
FIG. 5 is a flow sequence of backend calls for a electric chess and card data processing method in accordance with some embodiments.

The backend call sequence of the aforementioned Step S11 to Step S14 in accordance with some embodiments is shown in FIG. 5. Firstly, a matching card server reads a card distribution configuration table from a configure server. In some embodiments, the card distribution configuration table is resolved into a two-dimensional array for storage. Next, the matching card server informs the selecting card server to randomly select the card distribution configuration that meets the normal distribution probability, select the corresponding card combinations from the selecting card server according to the selected card distribution configuration. Only the card distribution configuration meeting the normal distribution probability is a valid selection, otherwise, the selection of this card distribution configuration is invalid, and another card distribution configuration is selected. If all the above steps are valid, the selecting card server will return the selected card distribution configuration. Then, according the number of occurrences specified for each meld type in the selected card distribution configuration, matching card server randomly select a corresponding number of card combinations for the meld type. The matching card server divides the serial number of roles into the groups, randomly selects one role from it, and distributes one card combination to this role, removes the assigned card combination from the array of card combinations. The matching card server removes the role with sufficient number of card combinations from the array of roles. The matching card server repeats the above steps for each card combination until all of the card combinations in the array of card combinations are distributed. Finally, other random cards in the deck are distributed to all roles. The matching card server also ensures that the cards held by each role conform to game rules (e.g., are smaller than the allowed number of cards per role), otherwise, the card distribution is invalid and needs to be redone. If the card distribution is successful, the matching card server will inform the configure server and the selecting server that the card distribution of this time is valid, return all the card combinations to the different roles, and transfer the cards distributed to each role to the corresponding client device of each role.

In relation to the conventional technology, the card distribution configurations in the electric chess and the selection probabilities of the card distributions in the card data processing method proposed by the present invention are independently configurable. The two of them can permutated with each other to generate many possibilities in accordance with a Cartesian product method. The process of generating a specific card distribution configuration needs not be concerned with the card distribution configuration as a whole. Instead, each meld type is generated based on its own probability interval table. Thus, the development of the card distribution configuration table is simple and efficient. The normal distribution probability of each card distribution configuration is a global probability that can by dynamically adjusted to make sure that there is no big deviation between the selection probabilities different card distribution configurations from an overall perspective (e.g., in many rounds of games). The present invention has a strong configurability. Upon packaging the card distribution configurations and the selection probabilities in an abstracted card distribution configuration table on the backend, if the card distribution configurations need to be changed (e.g., increased, decreased, deleted, added, etc.), the code for the card data processing need not be changed. Thus, regular change of card distribution configuration table can be made without the need to update backend server, achieving higher efficiencies. The present invention can also be implemented make it flexible and convenient to expand and update.

Figure 6:
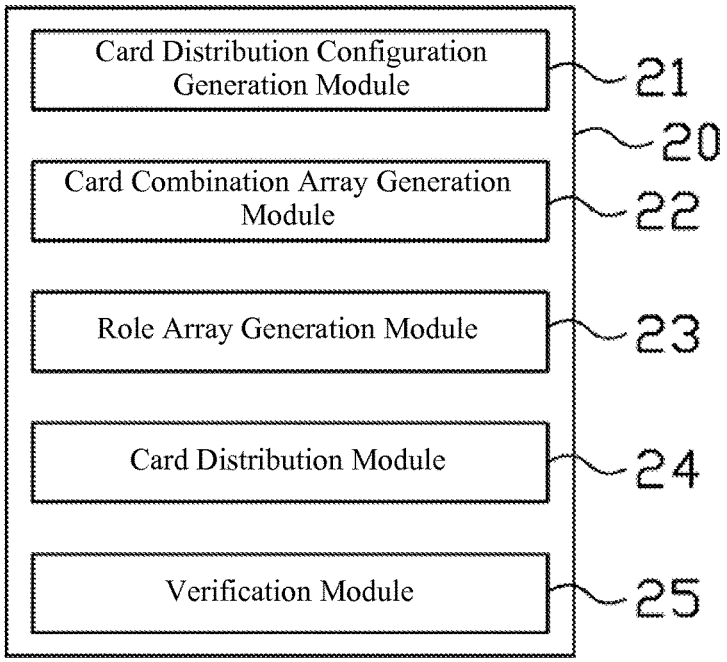
FIG. 6 is a structural schematic diagram of electric chess and card data processing system in accordance with some embodiments.

FIG. 6 is a structural schematic diagram of electric chess and card data processing system in accordance with some embodiments. In some embodiments, the electric chess and card data processing system 20 includes: card distribution configuration generation module 21, card combination array generation module 22, role array generation module 23, card distribution module 24 and verification module 25.

Card distribution configuration generation module 21 is used for generating the card distribution configuration table, the mentioned card distribution configuration table includes multiple card distribution configurations each including multiple meld types as well as a respective attribute value for each meld type, the attribute value corresponding to the meld type includes the number of card combinations matching the meld type in a game round, and each card distribution configuration has a respective predetermined selection probability (e.g., a normal distribution probability assigned to the card distribution configuration according to a normal distribution function).

Meld type array generation module 22 is used for reading the mentioned card distribution configuration table and select a card distribution configuration that has an actual selection frequency meeting its predetermined selection probability (e.g., the normal distribution probability). Meld type array generation module 22 also, according to the number of occurrences for each meld type in the selected card distribution configuration, select at random a corresponding number of card combinations from a deck of cards generated randomly. The selected card combinations are used to generate the card combination array.

Role array generation module 23 is used for generating an array of game roles.

Matching card module 24 is used for randomly distributing the card combinations in the mentioned card combination array to the roles selected from the mentioned array of roles, (optionally) subject to the constraints of an average or maximum number of melds to be assigned to a single role. Matching card module 24 also randomly distributing the remaining cards in the deck to all the roles in the mentioned array of roles, subject to the constraints of game rules.

Verification module 25 is used to verify the cards that are distributed to each role conform to game rules. If the cards are qualified after verification, the verification module 25 transfers the cards that are distributed to each role to the corresponding client-side of each role, otherwise, the process starts again from reading the mentioned card distribution configuration table.

Figure 7:
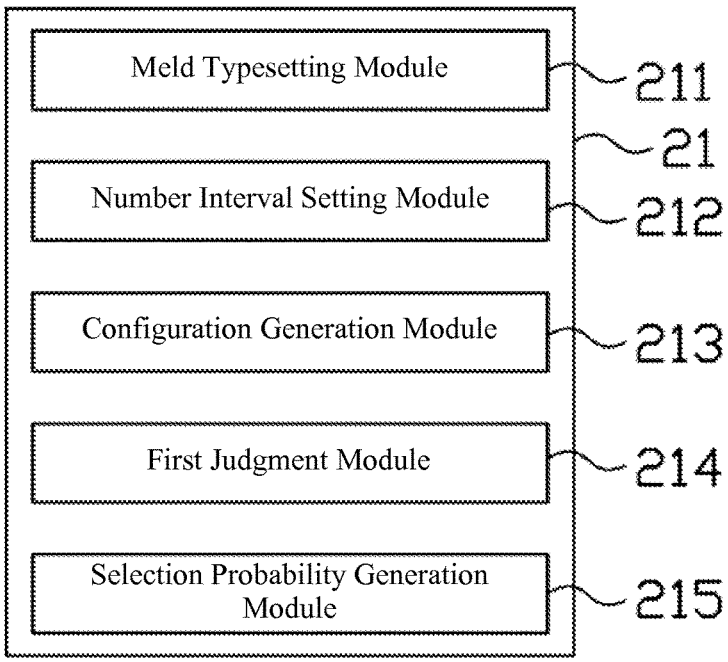
FIG. 7 is a structural schematic diagram of card type allocation module 21 in FIG. 6, in accordance with some embodiments.

FIG. 7 shows the mentioned card distribution configuration generation module 21, which includes: meld typesetting module 211, number interval setting module 212, configuration generation module 213, first judgment module 214 and selection probability generation module 215.

Meld typesetting module 211 is used for selecting at least two kinds of meld types according to the type of chess and card game, the selected combination of at least two kinds of good meld types are the mentioned meld types.

Number interval setting module 212 is used for setting the respective number interval for the possible number of occurrences for card combinations matching each meld type.

Configuration generation module 213 is used for generating the card distribution configuration by adopting a probability interval algorithm.

First judgment module 214 is used for determine whether the number of occurrence for each meld type in the generated card distribution configuration is within the probability interval of this meld type, if the judgment result is Yes, return the respective number of occurrences for each meld type in this card distribution configuration and store this card distribution configuration; otherwise, the mentioned configuration generation module 213 will re-generate the card distribution configuration. Stop generating the card distribution configurations when the stored card distribution configurations reach a predetermined number.

Selection probability generation module 215 is used for obtaining the selection probability (e.g., normal distribution probability) of each card distribution configuration, e.g., based on a normal distribution function.

Figure 8:
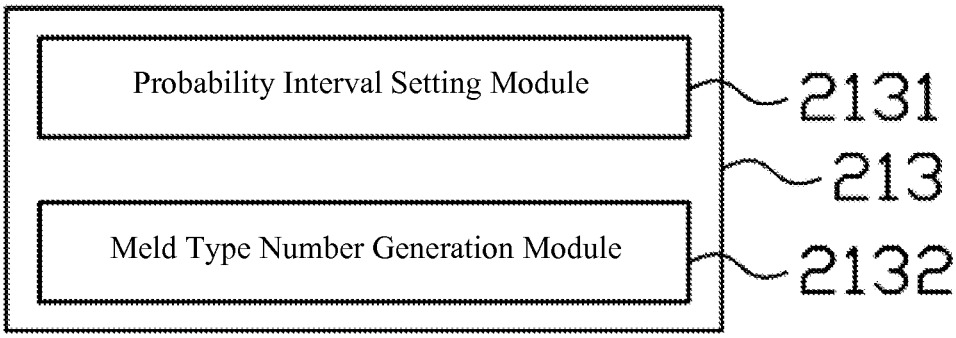
FIG. 8 is a structural schematic diagram of card type generation module 213 in FIG. 7, in accordance with some embodiments.

FIG. 8 shows the mentioned configuration generation module 213 which includes: probability interval setting module 2131 and meld type number generation module 2132.

Probability interval setting module 2131 is used for setting the respective probability intervals corresponding to the different possible numbers of occurrences for each meld type used to define all card distribution configurations according to the type of chess and card game, this probability interval is in unit of a percentage.

Meld type number generation module 2132 is used for randomly generating a large number for each meld type of a card distribution configuration to be generated, calculating the large number modulo 100 to get the remainder; setting the corresponding number of this remainder in the probability interval table as the number of occurrences for this meld type in the card distribution configuration to be generated.

Figure 9:
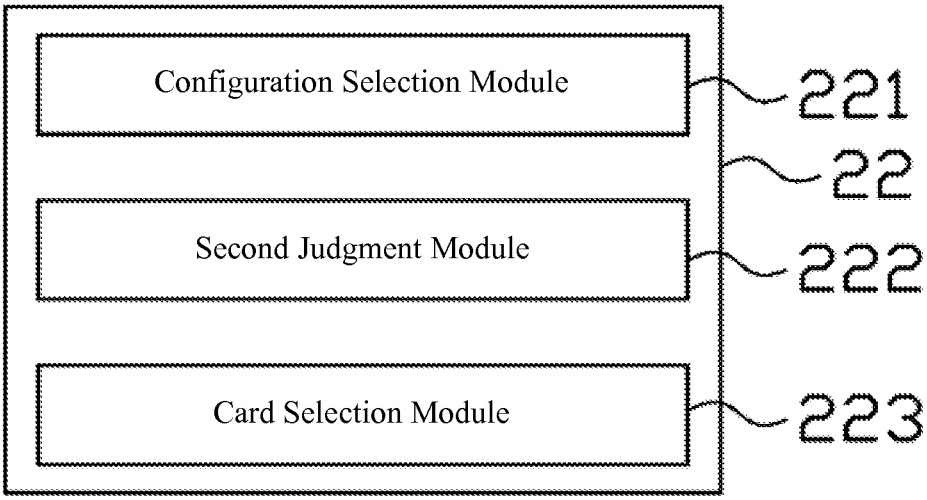
FIG. 9 is a structural schematic diagram of meld type array generation module 22 in FIG. 6, in accordance with some embodiments.

FIG. 9, the mentioned meld type array generation module 22 includes configuration selection module 221, second judgment module 222 and card selection module 223.

The mentioned configuration selection module 221 is used for selecting a card distribution configuration in the mentioned card distribution configuration table.

The mentioned second judgment module 222 is used for determining whether the actual probability of use (i.e., the selection frequency) of the card distribution configuration selected by the mentioned configuration selection module is smaller than the predetermined selection probability (e.g., normal distribution probability) of such card distribution configuration. The selection frequency is calculated by the number of times that this configuration has been selected so far divided by the total number of times all configurations have been selected so far. In some embodiments, the numbers of times for the selections can be reset periodically. If the judgment result is Yes, according to the respective numbers of occurrences for the different meld types in the selected card distribution configuration, the mentioned card selection module randomly takes out a corresponding number of card combinations matching each of meld types from a randomly generated (i.e., shuffled) deck of cards to generate the card combination array, otherwise the mentioned meld type selection module shall select another card distribution configuration.

Preferably, the verifying module 25 verifies the cards of all roles includes verifying the number of cards of each role according to game rules (e.g., whether the occurrence probability of each meld type of each role exceeds a preset probability or whether the difference of the meld types between roles exceeds the preset difference value.

Figure 10:
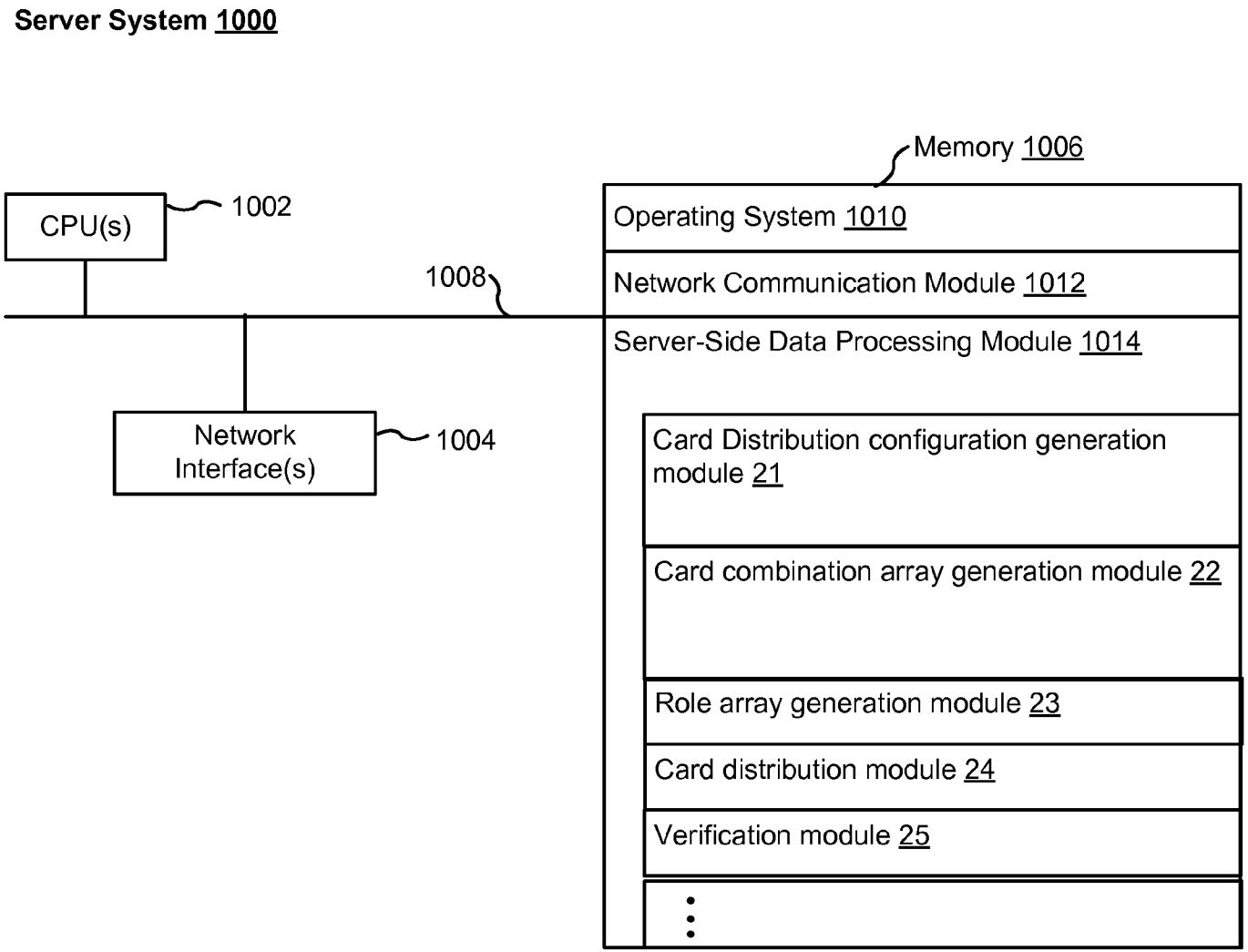
FIG. 10 is a block diagram of a device in accordance with some embodiments.

FIG. 10 is a block diagram illustrating a server system 1000 in accordance with some embodiments. Server system 1000, typically, includes one or more processing units (CPUs) 1002, one or more network interfaces 1004, memory 1006, and one or more communication buses 1008 for interconnecting these components (sometimes called a chipset). Memory 1006 includes high-speed random access memory, such as DRAM, SRAM, DDR RAM, or other random access solid state memory devices; and, optionally, includes non-volatile memory, such as one or more magnetic disk storage devices, optical disk storage devices, flash memory devices, or other non-volatile solid state storage devices. Memory 1006, optionally, includes one or more storage devices remotely located from the CPU(s) 1002. Memory 1006, or alternately the non-volatile memory device(s) within memory 1006, includes a non-transitory computer readable storage medium. In some implementations, memory 1006, or the non-transitory computer readable storage medium of memory 1006, stores the following programs, modules, and data structures, or a subset or superset hereof:

- an operating system 1010 including procedures for handling various basic system services and for performing hardware dependent tasks;
- a network communication module 1012 that is used for connecting server system 1000 to other computing devices (e.g., client devices) connected to one or more networks via one or more network interfaces 1004 (wired or wireless);
- a server-side data processing module 1014 for enabling server system 1000 to perform client environment data processing, including but not limited to: card distribution configuration generation module 21, card combination array generation module 22, role array generation module 23, card distribution module 24 and verification module 25.

Each of the above identified elements may be stored in one or more of the previously mentioned memory devices, and corresponds to a set of instructions for performing a function described above. The above identified modules or programs (i.e., sets of instructions) need not be implemented as separate software programs, procedures, or modules, and thus various subsets of these modules may be combined or otherwise re-arranged in various implementations. In some implementations, memory 1006, optionally, stores a subset of the modules and data structures identified above. Furthermore, memory 1006, optionally, stores additional modules and data structures not described above.

While particular embodiments are described above, it will be understood it is not intended to limit the invention to these particular embodiments. On the contrary, the invention includes alternatives, modifications and equivalents that are within the spirit and scope of the appended claims. Numerous specific details are set forth in order to provide a thorough understanding of the subject matter presented herein. But it will be apparent to one of ordinary skill in the art that the subject matter may be practiced without these specific details. In other instances, well-known methods, procedures, components, and circuits have not been described in detail so as not to unnecessarily obscure aspects of the embodiments.

Although some of the various drawings illustrate a number of logical stages in a particular order, stages that are not order dependent may be reordered and other stages may be combined or broken out. While some reordering or other groupings are specifically mentioned, others will be obvious to those of ordinary skill in the art and so do not present an exhaustive list of alternatives. Moreover, it should be recognized that the stages could be implemented in hardware, firmware, software or any combination thereof.

What is claimed is:

1. A computer-implemented method for processing electronic card game data, comprising:

at a matching card server having one or more processors and memory:

reading a card distribution configuration table from a configure server, wherein the card distribution configuration table is created by:

selecting a set of meld types used to define a plurality of card distribution configurations;

selecting a respective number range for each of the set of meld types, the respective number range specifying at least a minimum number of times and a maximum number of times that said each meld type occurs in a game round;

generating a respective number of occurrences for each of the set of meld types within the respective number range of said each meld type based on a random number generator and a respective probability interval table for said each meld type, wherein the respective probability interval table contains probability intervals corresponding to all possible numbers of occurrences for said each meld type, wherein:

for a first meld type of the set of meld types, the respective probability interval table includes a first probability interval for the minimum number of times that the first meld type occurs in the game round, and a second probability interval for the maximum number of times that the first meld type occurs in the game round; and storing the respective numbers of occurrences for all of the set of meld types as a newly generated card distribution configuration in the card distribution configuration table;

informing a selecting card server to select a respective card distribution configuration from the card distribution configuration table, the respective card distribution configuration being defined by a respective set of meld types and the respective number of occurrences for each of the respective set of meld types of the respective card distribution configuration, the respective number of occurrences specifying a total number of times that card combinations matching said each meld type of the respective set of meld types occurs in the game round;

receiving the selected respective card distribution configuration from the selecting card server;

according to the respective number of occurrences for each meld type of the respective set of meld types of the selected respective card distribution configuration, randomly selecting from a deck of cards a corresponding number of card combinations matching said each meld type;

distributing the selected card combinations for each meld type of the respective set of meld types of the respective card distribution configuration to a plurality of game roles; and distributing a remainder of cards in the deck to the plurality of game roles.

2. The method of claim 1, wherein informing the selecting card server to select the respective card distribution configuration from the card distribution configuration table further comprises:

the selecting card server determining whether a respective selection frequency of the respective card distribution configuration satisfies a respective predetermined selection probability assigned to the respective card distribution configuration; and the selecting card server repeating the selecting and determining for a different card distribution configuration from the plurality of card distribution configurations until a respective selection frequency of the different card distribution configuration satisfies a respective predetermined selection probability assigned to the different card distribution configuration.

3. The method of claim 1, further comprising:

the configure server assigning a respective predetermined selection probability to each card distribution configuration in the card distribution configuration table.

4. The method of claim 3, wherein the respective predetermined selection probabilities assigned to the plurality of card distribution configurations in the card distribution configuration table follow a normal distribution.

5. The method of claim 1, wherein distributing the selected card combinations for said each meld type of the respective set of meld types of the respective card distribution configuration to the plurality of game roles further comprises:

calculating an average number of card combinations to be assigned to each of the plurality of game roles;

for each of the selected card combinations, selecting a respective role to assign said each card combination at random from the plurality of game roles; and verifying that the respective role has fewer than the average number of card combinations before assigning said each card combination to the respective role.

6. The method of claim 1, further comprising:

verifying that all cards distributed to each game role conform to game rules.

7. A system including a matching card server for processing electronic card game data, comprising:

one or more processors; and memory having instructions stored thereon, the instructions, when executed by the one or more processors, cause the processors to perform operations comprising:

reading a card distribution configuration table from a configure server, wherein the card distribution configuration table is created by:

selecting a set of meld types used to define a plurality of card distribution configurations;

selecting a respective number range for each of the set of meld types, the respective number range specifying at least a minimum number of times and a maximum number of times that said each meld type occurs in a game round;

generating a respective number of occurrences for each of the set of meld types within the respective number range of said each meld type based on a random number generator and a respective probability interval table for said each meld type, wherein the respective probability interval table contains probability intervals corresponding to all possible numbers of occurrences for said each meld type, wherein:

for a first meld type of the set of meld types, the respective probability interval table includes a first probability interval for the minimum number of times that the first meld type occurs in the game round, and a second probability interval for the maximum number of times that the first meld type occurs in the game round; and storing the respective numbers of occurrences for all of the set of meld types as a newly generated card distribution configuration in the card distribution configuration table;

informing a selecting card server to select a respective card distribution configuration from the card distribution configuration table, the respective card distribution configuration being defined by a respective set of meld types and the respective number of occurrences for each of the respective set of meld types of the respective card distribution configuration, the respective number of occurrences specifying a total number of times that card combinations matching said each meld type of the respective set of meld types occurs in the game round;

receiving the selected respective card distribution configuration from the selecting card server;

according to the respective number of occurrences for each meld type of the respective set of meld types of the selected respective card distribution configuration, randomly selecting from a deck of cards a corresponding number of card combinations matching said each meld type;

distributing the selected card combinations for each meld type of the respective set of meld types of the respective card distribution configuration to a plurality of game roles; and distributing a remainder of cards in the deck to the plurality of game roles.

8. The system of claim 7, wherein informing the selecting card server to select the respective card distribution configuration from the card distribution configuration table further comprises:

the selecting card server determining whether a respective selection frequency of the respective card distribution configuration satisfies a respective predetermined selection probability assigned to the respective card distribution configuration; and the selecting card server repeating the selecting and determining for a different card distribution configuration from the plurality of card distribution configurations until a respective selection frequency of the different card distribution configuration satisfies a respective predetermined selection probability assigned to the different card distribution configuration.

9. The system of claim 7, wherein the operations further comprise:

the configure server assigning a respective predetermined selection probability to each card distribution configuration in the card distribution configuration table.

10. The system of claim 9, wherein the respective predetermined selection probabilities assigned to the plurality of card distribution configurations in the card distribution configuration table follow a normal distribution.

11. The system of claim 7, wherein distributing the selected card combinations for said each meld type of the respective set of meld types of the respective card distribution configuration to the plurality of game roles further comprises:

calculating an average number of card combinations to be assigned to each of the plurality of game roles;

for each of the selected card combinations, selecting a respective role to assign said each card combination at random from the plurality of game roles; and verifying that the respective role has fewer than the average number of card combinations before assigning said each card combination to the respective role.

12. The system of claim 7, wherein the operations further comprise:

verifying that all cards distributed to each game role conform to game rules.

13. A non-transitory computer-readable storage medium having instructions stored thereon, the instructions, when executed by one or more processors of a matching card server, cause the processors to perform operations comprising:

reading a card distribution configuration table from a configure server, wherein the card distribution configuration table is created by:

selecting a set of meld types used to define a plurality of card distribution configurations;

selecting a respective number range for each of the set of meld types, the respective number range specifying at least a minimum number of times and a maximum number of times that said each meld type occurs in a game round;

generating a respective number of occurrences for each of the set of meld types within the respective number range of said each meld type based on a random number generator and a respective probability interval table for said each meld type, wherein the respective probability interval table contains probability intervals corresponding to all possible numbers of occurrences for said each meld type, wherein:

for a first meld type of the set of meld types, the respective probability interval table includes a first probability interval for the minimum number of times that the first meld type occurs in the game round, and a second probability interval for the maximum number of times that the first meld type occurs in the game round; and storing the respective numbers of occurrences for all of the set of meld types as a newly generated card distribution configuration in the card distribution configuration table;

informing a selecting card server to select a respective card distribution configuration from the card distribution configuration table, the respective card distribution configuration being defined by a respective set of meld types and the respective number of occurrences for each of the respective set of meld types of the respective card distribution configuration, the respective number of occurrences specifying a total number of times that card combinations matching said each meld type of the respective set of meld types occurs in the game round;

receiving the selected respective card distribution configuration from the selecting card server;

according to the respective number of occurrences for each meld type of the respective set of meld types of the selected respective card distribution configuration, randomly selecting from a deck of cards a corresponding number of card combinations matching said each meld type;

distributing the selected card combinations for each meld type of the respective set of meld types of the respective card distribution configuration to a plurality of game roles; and distributing a remainder of cards in the deck to the plurality of game roles.

14. The computer-readable medium of claim 13, wherein informing the selecting card server to select the respective card distribution configuration from the card distribution configuration table further comprises:

the selecting card server determining whether a respective selection frequency of the respective card distribution configuration satisfies a respective predetermined selection probability assigned to the respective card distribution configuration; and the selecting card server repeating the selecting and determining for a different card distribution configuration from the plurality of card distribution configurations until a respective selection frequency of the different card distribution configuration satisfies a respective predetermined selection probability assigned to the different card distribution configuration.

15. The computer-readable medium of claim 13, wherein the operations further comprise:

the configure server assigning a respective predetermined selection probability to each card distribution configuration in the card distribution configuration table.

16. The computer-readable medium of claim 15, wherein the respective predetermined selection probabilities assigned to the plurality of card distribution configurations in the card distribution configuration table follow a normal distribution.

17. The computer-readable medium of claim 13, wherein distributing the selected card combinations for said each meld type of the respective set of meld types of the respective card distribution configuration to the plurality of game roles further comprises:

calculating an average number of card combinations to be assigned to each of the plurality of game roles;

for each of the selected card combinations, selecting a respective role to assign said each card combination at random from the plurality of game roles; and verifying that the respective role has fewer than the average number of card combinations before assigning said each card combination to the respective role.

* * * * *